US009914510B2

(12) United States Patent
De Maeyer et al.

(10) Patent No.: US 9,914,510 B2
(45) Date of Patent: Mar. 13, 2018

(54) YACHT OR SHIP HAVING LIGHTING ELEMENTS ON OR IN HULL

(71) Applicant: Oceanco Shipbuilders & Partners Ltd., Nassau (BS)

(72) Inventors: Evy De Maeyer, Kallo (BE); Pieter Van Geest, Amsterdam (NL); Tiphaine Treins, Paris (FR)

(73) Assignee: Oceanco Shipbuilders & Partners Ltd., Nassau (BS)

( * ) Notice: Subject to any disclaimer, the term of this patent is extended or adjusted under 35 U.S.C. 154(b) by 171 days.

(21) Appl. No.: 14/785,824

(22) PCT Filed: Apr. 17, 2014

(86) PCT No.: PCT/EP2014/057974
§ 371 (c)(1),
(2) Date: Oct. 20, 2015

(87) PCT Pub. No.: WO2014/173834
PCT Pub. Date: Oct. 30, 2014

(65) Prior Publication Data

US 2016/0101837 A1 Apr. 14, 2016

(30) Foreign Application Priority Data

Apr. 22, 2013 (EP) ..... 13164781

(51) Int. Cl.
*B63B 45/00* (2006.01)
*B63B 45/06* (2006.01)
(Continued)

(52) U.S. Cl.
CPC ..... *B63B 45/00* (2013.01); *B63B 3/68* (2013.01); *B63B 45/06* (2013.01); *F21W 2101/04* (2013.01)

(58) Field of Classification Search
CPC ..... B63B 45/00; B63B 3/68; B63B 45/06
See application file for complete search history.

(56) References Cited

U.S. PATENT DOCUMENTS 8,230,575 B2 * 7/2012 Veenstra ..... B60Q 1/2696 174/377
2005/0247233 A1 11/2005 Kwon
(Continued)

FOREIGN PATENT DOCUMENTS

CN 201457711 U 5/2010
CN 202244013 U 5/2012
(Continued)

OTHER PUBLICATIONS

Live from DIBS: Oceanco and Van Geest Design unveil 90m concept Moonstone, dated Mar. 2, 2016, <URL: http://www.superyachttimes.com/yacht-news/live-from-dibs-oceanco-and-van-geest-design-unveil-90m-concept-moonstone>, retrieved from internet Sep. 18, 2017.
(Continued)

*Primary Examiner* — Sharon Payne
(74) *Attorney, Agent, or Firm* — Sterne, Kessler, Goldstein & Fox P.L.L.C.

(57) ABSTRACT

The current invention relates to a yacht or other vessel, such as a ship, comprising a hull and a superstructure, wherein at least one of the hull and the superstructure comprises cladding elements thereon or therein, wherein at least a selection of the cladding elements comprise an at least partially transparent cover and at least one light source, wherein the light source is shielded by the cover. Furthermore, the invention relates to a cladding element containing light sources, to be in use arranged on the hull of a yacht, or in swimming pools and in particular side walls and/or bottoms thereof, as well as on surrounding structures, like a pool house or paths or pavements there around, in bridges,
(Continued)

for example on bridge decks and/or against uprights and/or stairs and/or walls, or in ornamentation of public spaces and public structures.

19 Claims, 4 Drawing Sheets

(51) Int. Cl.
*B63B 3/68* (2006.01)
*F21W 101/04* (2006.01)

(56) References Cited

U.S. PATENT DOCUMENTS

| | | | |
|---|---|---|---|
| 2006/0094315 | A1 | 5/2006 | Brodsky |
| 2007/0032319 | A1 | 2/2007 | Tufte |
| 2007/0139913 | A1 | 6/2007 | Savage |
| 2008/0037284 | A1 | 2/2008 | Rudisill |

FOREIGN PATENT DOCUMENTS

| | | | |
|---|---|---|---|
| DE | 202009016078 | U1 | 3/2011 |
| JP | 03-014783 | A1 | 1/1991 |
| WO | 2008011558 | A2 | 1/2008 |

OTHER PUBLICATIONS

International Search Report and Written Opinion of Appl. No. PCT/EP2014/057974 dated Sep. 5, 2014, 12 pages.
Written Opinion of the International Preliminary Examining Authority of Appl. No. PCT/EP2014/057974 dated May 11, 2015, 5 pages.

* cited by examiner

YACHT OR SHIP HAVING LIGHTING ELEMENTS ON OR IN HULL

The present invention relates to a vessel, and in particular a yacht or maybe even a ship, comprising a hull and a superstructure.

Such vessels and in particular yachts are known in the art in numerous embodiments, for example from US-2007/032319 and/or US-2005/247233, which both disclose only light emitting stripes, or WO-2008/011558, which discloses light emitting patches on a vehicle, such as a yacht.

Although such yachts provide the owner and/or his or her guests a diversity of possibilities to spend time, in the eyes of many prospective and actual owners known yachts appear to be missing an as yet previously not recognized functionality.

The present invention is directed at attempting to fulfil a need for even more and extensive leisure possibilities.

To this end, the present invention relates to a yacht, which in contrast with conventional yachts comprises cladding elements on the hull. More in detail, a yacht or other vessel, such as a ship, according to the present invention comprises a hull and a superstructure, wherein the hull comprises cladding elements thereon or therein, wherein at least a selection of the cladding elements comprise an at least partially transparent cover and comprise at least one light source, shielded by the cover. By providing the cladding elements onto or in essentially the whole of hull of the vessel, in particular the yacht or the ship, in particular facing outward, a completely new appearance of such a yacht can be provided, relative to prior art yachts, which only have a steel hull having—what is considered to be—a relatively dull appearance. Prior art yachts having an aluminium, composite or wooden skin or hull, can also be the subject of the present invention, but the invention may also be put to good practical use in other environments or fields of application than yachts. According to the present invention the technical solution to this problem is provided in the form of the cassette-like cladding elements with light sources. More in particular, the vessel comprises a plurality of cassette-like cladding elements, which are designed to cover the at least one surface of the hull and the superstructure in a mutually closely fitting adjoining configuration of sets of the plurality of cassette-like cladding elements to cover the at least one surface for essentially the most part and to generate the appearance of illumination over the essentially entire surface, in contrast with vessels, such as yachts or ships according to the aforementioned prior art which provide only illumination stripes. Thereby, essentially the entire surface of the hull or of the superstructure seems to be light emitting when the light sources are switched on, to create an impression of illumination from and over the essentially entire surface, in stead of being merely illuminated or providing illuminating stripes.

Preferably, such cassette-like cladding elements allow adaptation of the visual appearance of the yacht.

According to the present invention and within the framework thereof according to the appended independent claim, numerous preferred embodiments have been made possible, as defined in the dependent claims. However, also other embodiments are possible within the scope of protection of the present invention, other than the features, that have been defined in the dependent claims.

More in particular, the vessel according in a preferred embodiment of the present invention can be such, that the selection of the cladding elements comprise a plurality of light sources embedded in or arranged behind a transparent part thereof, such as the cover. With a plurality of light sources, a more homogenous output of light from each of the cladding elements is possible, further enhancing the visual appearance and possibly also adaptation thereof.

In an additional or alternative embodiment the vessel according to the present invention can be such that the at least one light source comprises light elements, such as LED lights, of different colours. Features of such an embodiment enable a further adaptability and diversity of appearances of a side of the hull of a ship, thereby further increasing the possibilities for ships owner or captain or the like to change the appearance of the ship by using varying colour schemes. Preferably, the colour of each cassette or cladding element can be adjusted individually. Additionally and/or alternatively, and embodiment may be envisaged or realized in which light control is provided for each individual light source and/or on a point-by-point basis, within each cassette or cladding or possibly even for corresponding points and/or light sources of more than one cladding or cassette simultaneously, for instance in case of multiple similar cassettes or cladding, to provide overall light effects over the entirety of the hull of the vessel.

In such an embodiment it may be considered beneficial to have the vessel further comprise a control connected to the light elements and input means to adapt a cladding element appearance. Thus, in addition to being able to adapt a hull appearance in total, this supplemental embodiment enables appearance control up to a cladding element level.

In an additional or alternative embodiment the vessel according to the present invention can be such that brackets are secured to the hull and arranged to engage one or more than one of the cladding elements. Such brackets can be welded onto or otherwise arranged on a hull to allow the cladding elements to be arranged on or in the hull. In case of a depression or indentation in the normal hull shape to allow cladding elements to be arranged therein, the original form of the hull may be maintained. Additional features or alternative measures can also be taken to arrange the cladding elements onto or into the hull.

For instance, in an additional or alternative embodiment the vessel according to the present invention can be such that adhesive or glue is provided, by means of which the cladding elements are connected to the hull. If appropriate or suitable adhesives or glues are used, these can also function to seal transitions between the bull and the cladding elements and between cladding elements, to ensure a watertight closure of the transitions.

In an additional or alternative embodiment the vessel according to the present invention can be such that the hull is formed with an indentation to accommodate the cladding elements. As indicated above, such an indentation can serve to maintain an original shape of a hull, even while additional cladding elements are mounted on the hull and more in particular in such indentations or recesses, that have then in particular been provided for said purpose.

In an additional or alternative embodiment the vessel according to the present invention can be such that cladding elements are arranged on the hull above a waterline of the vessel. The visual appearance of the vessel is thereby most effectively adaptable, since under the waterline this appearance is only visible to divers, which does not preclude an embodiment according to the invention having cladding elements underneath the waterline of the hull.

In an additional or alternative embodiment the vessel according to the present invention can be such that the at least one light source is arranged between ribs extending at least from the at least one light source to the cover. Thereby the cladding can be given a desired robustness or strength, even when relative light cover panels are employed as the cover.

In an additional or alternative embodiment the vessel according to the present invention can be such that at least one of the cladding elements comprises a backing with the light source thereon, and a transparent cover is arranged opposite the backing encapsulating the light source there between. This is a particularly simple and elegant embodiment for manufacturing the cladding elements in a cassette-like manner, enabling modular configurations and even arranging cladding elements at different locations then only the hull, for instance for the purpose of overhead lighting of boardways. As will be noted below, the claddings in themselves can also be usefully employed in other fields of use than on the hulls of vessels.

In such an embodiment, a backing can be formed by a metal plate or such a plate can be made from any other suitable material that can withstand the rigorous circumstances to which up hull of a ship is subjected, such as salt water, waves, wind and the like. In particular, the vessel can have cladding elements having a backing formed from or by an aluminium plate. Aluminium is sufficiently strong and practically suitable for the purpose of providing a sturdy base of and for the cladding elements.

Alternatively or additionally, metal, resin and plastic can be used for the backing, as well as any other material suitable for the circumstances and influences, to which the claddings are subjected in different fields of use.

In this embodiment of cladding elements with a backing and a transparent layer thereon it may be beneficial if the backing is curved in correspondence with a portion of the hull to which the cladding element is arranged. Thereby a close fitting arrangement of the cladding elements onto or into the hull can be provided, to reduce or minimise seawater or other fluids from being trapped between the whole and the cladding elements.

In this embodiment of cladding elements with a backing and a transparent layer thereon it may be beneficial if on or in the transparent layer, opposite the backing, a light diffusing layer is arranged, and/or a circumferential side of the transparent cover comprises a light reflecting layer. By using the diffusing layer, a homogenous appearance in terms of light and colour of each cladding element can be ensured, and thereby also of the hull in its entirety. By arranging a light reflecting layer on the circumferential side of the transparent layer, a maximised output of generated light from the light sources can be ensured, without such light being trapped in the transparent layers of the cassette-like cladding elements.

In an additional or alternative embodiment the vessel according to the present invention can be such that at least a selection of cladding elements forms a cassette designed to be individually mountable to and/or dismountable from the hull and connectable to and disconnectable from a light source control for separate mounting and light controlling of the cladding elements. In such an embodiment and enhanced modular system is realised, wherein individual cladding elements can be mounted or removed, preferably without any effect on the light generating functionality of other cladding elements already or still mounted on the hull.

In an additional or alternative embodiment the vessel according to the present invention can be such that sides of the cladding are sealed using at least one material from a group at least comprising: a setting material, a thermoplastic material. Thus an effective seal against sea or rain water may be provided to stop rain or sea water from entering an interior of the cladding according to the invention.

In an additional or alternative embodiment the vessel according to the present invention can be such that the at least one of the surfaces of the cladding from the group of: a backing; a compartment layer; a top; and a side surface is designed to be at least water resistant and preferably water proof to a desired extent, while additionally being adapted to be removed from the cladding to allow for maintenance to the interior of the cladding and/or replacement of light sources in the interior thereof. Consequently, there is no need to replace an entire cladding in case (a selected minimum number of) light sources have broken. Also other maintenance on the interior of the cladding may be performed, whilst the cladding can be sealed again after the maintenance has been completed, and/or light sources, such as LED light bulbs, are replaced.

In an additional or alternative embodiment the vessel according to the present invention can be such that transitions between cladding elements are closed with an essentially watertight seal. As indicated above, it is not considered desirable to have seawater or other fluids freely flowing between the hull and the cladding elements or between the cladding elements themselves.

In an additional or alternative embodiment the vessel according to the present invention can be such that a top coat paint is arranged on or over the at least partially transparent cover, which top coat is designed to give the impression of a normally coloured hull, when the lights sources are switched off, for example in the day time, and to be light transmitting to illuminate outward of the hull, when the light sources are lit.

It is expressly noted here that the present invention not only relates to a yacht, vessel or ship, to the hull of which cladding elements having a light generating functionality are arranged, but also to a cladding element on its own containing light sources, to be in use arranged on the hull of a vessel, such as a yacht or ship, as claimed in any one or more than one of the vessel, yacht or ship related claims.

Following the brief indication above of the present invention, herein below are more detailed description of a possible embodiment is provided, to which the present invention is by no means limited or restricted since the invention is only and exclusively delimited in the appended independent claims. The following description of a possible embodiment is to be taken in conjunction with the accompanying drawing, in which the same or similar features, components and elements can be designated with the same or a similar reference numbers, even though distinct embodiments can be referred to, and wherein:

Figure 1:
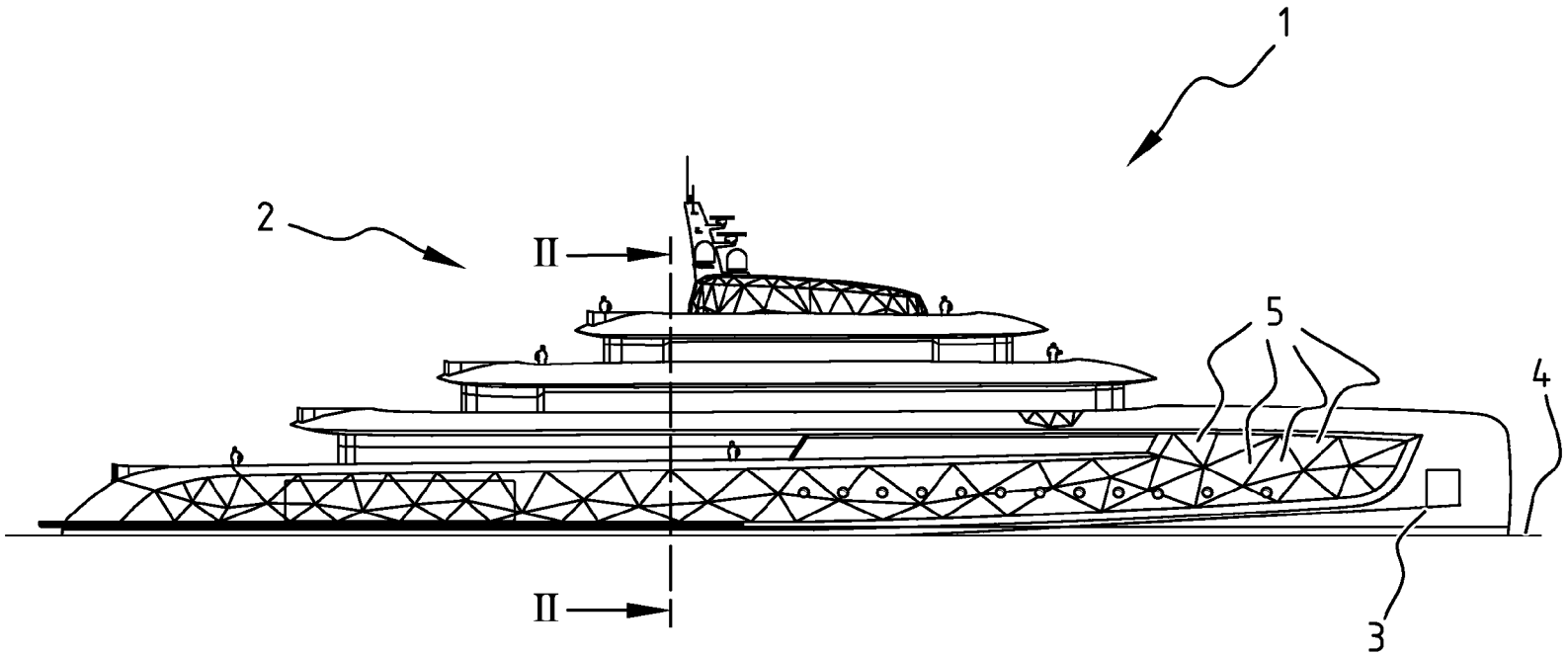
FIG. 1 shows a side view of a yacht according to the present invention.

In FIG. 1, a side view is shown of a yacht 1, comprising a superstructure 2 on a hull 3. Of the hull 3 only a portion above waterline 4 is shown. The portion of hull 3 above waterline 4 is provided with cassette like cladding elements 5, to be described in more detail below, referring to FIG. 2.

The cladding elements 5 are shown to have essentially triangular circumferential shapes, but other shapes are naturally also possible, such are square, rectangular or honeycomb shaped, at cetera. The cassette-like cladding elements 5 are shown to cover a side of the hull 3 for essentially the most part, but not all of the side of the hull 3. In alternative embodiments the light emitting cassette-like cladding elements 5 could cover less of the side of the hull 3, or even more. For instance the cladding elements could further be arranged on or against (portions of) a superstructure or a mast. The cassette-like cladding elements 5 are configured to emit light of at least one colour, as will be described in more detail below in relation to FIG. 2.

Figure 2:
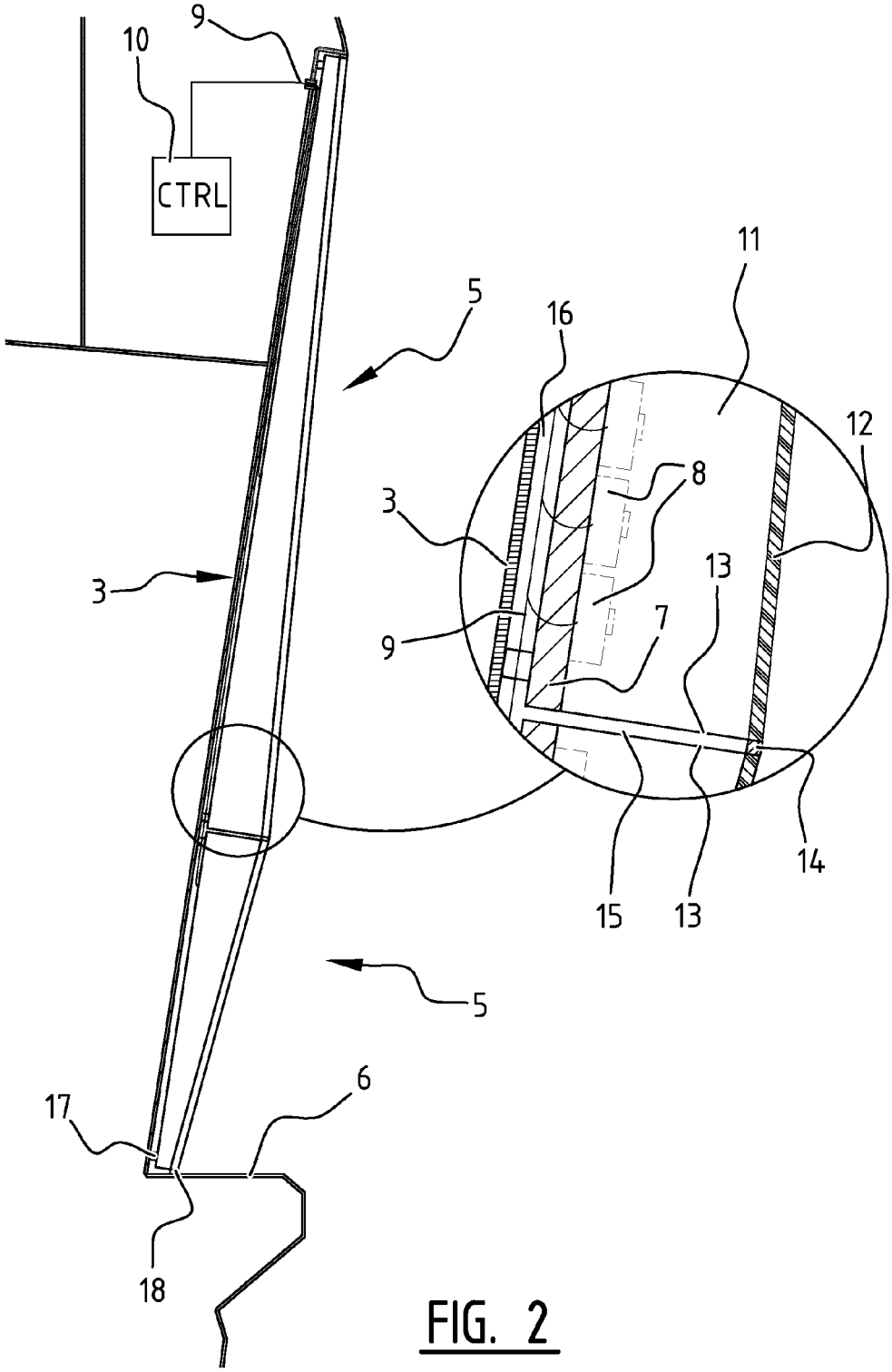
FIG. 2 shows a more detailed view in section II-II in FIG. 1.

As shown in view of FIG. 2 of a side cross sectional view along line II-II in FIG. 1, the ship's hull 3 has an indentation or recess or the like, defined by a shoulder 6 for a cladding element 5 to be supported on. Higher up on hull 3 a further cladding element 5 is arranged. The cladding elements 5 are designed to cover surface of the hull 3 in a closely fitting manner, so as to appear unitary already from a short distance, at least with respect to light emitted from the cladding elements 5. This is to say that preferably no dark lines corresponding with transitions between cladding elements 5 are visible, already at a short distance from hull 3 or from the entire yacht 1 in FIG. 1.

Cladding elements 5 are preferably configured—although alternatives will be readily evident to the skilled reader—from a base 7, that can be manufactured from any material suitable to withstand the harsh conditions at sea, such as metal, in particular aluminium, composite material, plastics, and/or the like, in so far as a sufficiently sturdy base for the cassette-like panels or cladding elements 5 can thereby be formed. The base 7 forms a carrier for light sources 8, which are preferably LED light sources in view of their durability, power consumption and light efficiency, although other types of light sources will be evident to the skilled reader, even if such other types of light sources are less durable or less economical or less efficient than LED light sources. In view of heat dissipation for heat generated by the light sources 8 or LED's, base 7 is preferably manufactured from a material having a sufficient heat guiding capacity, such as a metal or even aluminium.

The light sources 8 can be connected to a power source (not shown) via cables 9, that protrude through hull 3 at a safe height above waterline 4 or can protrude through watertightly closed passages at arbitrary height on hull 3. It is even possible to arrange sockets in or on hull 3 and arrange plugs on the cable 9 to allow the LED's 8 to be connected to a power source in a plugged manner. Preferably, cables 9 connect via a control 10 to a power source, such as an on-board generator, where control 10 can be configured to determine which of the panels or cladding elements 5 are powered (more in particular the LED's of which the cladding elements 5) and/or even which LED's 8 are to be driven, if the LED's come in different colours or if any LED's can be driven in multiple colours. For instance the control can be used to determine that a selected on of the cladding elements needs to be disconnected (for replacement or maintenance) so that such tasks can be performed without any risk to a maintenance crew.

The light sources 8 are thus arranged on base 7 and are moreover encapsulated in an assembly of base 7 and a transparent layer 11. The transparent layer 11 may be manufactured from a plastic or a resin, again preferably suitable to withstand harsh conditions and influences at and of the sea. For instance the transparent layer 11 can be a material commonly referred to as SP-Gurit 115 or 320. The invention is however not limited to this specific choice of material. The transparent material of or for transparent layer 11 can have been cast on base 7 after the LED's 8 are first arranged thereon and connected to at least the cable 9.

On an outside oriented surface of the transparent layer 11, a diffuser layer 12 can be arranged. For instance a composite diffuser panel can be employed to embody such a diffuser layer 12. Thereby, light emitted by the light sources 8 (for instance but not exclusively LED's) can be diffused to provide a homogenous optical effect.

Additionally, a white gel coat top layer can be provided for diffuser layer 12, for which clear resin can be employed to enhance the resistance of cladding elements 5 against the elements of wind and sea, and for instance such a layer or the diffuser layer 2 can comprise some additive or the like to provide UV protection.

Further additionally or alternatively a top coat paint can be arranged, to give the impression of a normally white, grey or black hull 3 (or any other colour considered conventional) so that when the lights sources 8 are switched off (for example in the day time) the yacht does not give an impression of any special feature; only when the sun goes down and the light sources are lit through the controller 10 is the special nature of yacht 1 according to the present invention revealed. Such a top coat paint should be light transmitting, and a material commonly referred to as clear awlgrip or a similar coating can be employed.

Yet further the circumferential sides of the cladding elements 5, more in particular the circumferential sides of the transparent layer 11, may be covered with a reflecting layer 13, to ensure as much as possible of the light from the light sources 8 is actually emitted out of the cladding elements 5. Moreover, transitions or joints between cladding elements 5, such as in the insert portion in FIG. 2, may be sealed with a joint 14 to ensure watertight mutual connection of the cladding elements 5. For this a material commonly referred to as a sikaflex joint may be employed.

Preferably the cladding elements 5 abut closely against the curvature of hull 3. For this, base 7 may be curved in correspondence with hull 3. Additionally, the thickness of the cladding elements is preferably uniform over the area thereof, in order to secure a uniform emission of light from the cladding elements. However, according to the invention, the thickness of the cladding element does not necessarily need be constant over the entire cladding element, as clear from the representation of FIG. 2, especially by comparing this thickness at several heights along hull 3 in FIG. 2. It is considered desirable to have cladding elements 5 abut closely to or even have full contact with the ship's hull 3. Thereby, also hull 3 can contribute to heat dissipation in relation to heat from light sources 8. Moreover, cladding elements 5 are thereby better apt to withstand influences from the sea and wind, and remain well fixed to hull 3. Optionally, a filling material can be employed to fill any space between hull 3 and cladding elements 5, for instance a glue or adhesive, which may in itself function to arrange the cladding elements 5 to hull 3. Filling materials can also be cork or foam, or the like.

To secure cladding elements 5 to hull 3, use can be made of brackets 15 which may be welded or bolted onto hull 3. Additionally or alternatively, the aforementioned adhesive or glue 16 may be employed to attach cladding elements 5 to the ship's hull 3. The cladding elements may comprise a shoulder or flange, as exhibited in FIG. 3 at the right side in that drawing, with optionally through holes therein for mounting cladding elements to a supporting surface, such as the hull of the ship, yacht or other vessel or a stationary object.

At the back of lowermost cladding element 5 in FIG. 2 a further fixing 17 is shown to secure cladding element 5 to hull 3, as well as a seal 18.

In an alternative embodiment relative to cladding elements 5 of FIG. 2, FIGS. 3, 4 and 5 show that a cladding element 20 can be composed from a foundation layer 21, on which a compartment layer 22 is accommodated. The foundation layer 21 is preferably designed for at least one of chemical and mechanical connection to a carrying surface such as a hull of a yacht, boat or ship. Preferably further, the foundation layer 21 is suitable to withstand deformation resulting from ship movements. For instance the foundation layer may be sufficiently rigid to strengthen the hull of a yacht, or be flexible enough to bend with such movements. However, the latter option would pose challenges on the overlying structures. Such movements may be generated by the swell of the sea or any other body or water, but likewise temperature fluctuations may cause extension and crimp, which is also included in the meaning of the expression of movements, even in fields of applications where claddings according to the invention are mounted on or against stationary objects (unlike yachts, that sail).

The compartment layer 22 comprises ribs 23, which extend from the foundation layer 21 to an upper layer 24 of the compartment layer 22. The ribs 23 extend in the shown embodiment away from the foundation layer 21 under an essentially straight angle to define there between seats 25 for light sources 26. From the seats 25, the ribs 23 extend obliquely towards the upper layer 24, to define diverging shapes in the direction towards the upper layer 24 of the compartment layer 22. Alternatively, the ribs may extend to the upper layer under an essentially straight angle from the foundation layer 24, without the diverging shape between the seats 25 and the upper layer 25. The angle of the ribs—if provided—may be chosen or more preferably designed in conjunction with a distance from the light sources 26 to diffuser layer 27 (see below). With the aim of achieving homogeneous light output, the portions of the ribs 23 above the seats 25 may extend at an angle between 90° and 30°, more preferably between 45° and 60°. The actually chosen/designed angle will also depend on the light scattering/diffusing properties of the ribs 23.

Light sources 26 are, in the shown embodiment, arranged on the seats 25 in series extending through trough-like elongate spaces, defined by the ribs 23. The light sources may be any type of LED light sources, such as RGB, W, WW, CW, DW, O-led or the like. Any other type of source may also comply with the requirement of low power consumption, high efficiency and maximum light output and ability to be diffused at short distance from the sources and/or to be mounted closely enough in view of for instance heat development to achieve the homogeneous external lighting of the object, to which claddings 20 are mounted.

The lights 26 may be embedded in a resin or plastic, to enhance the resistance thereof to for instance sea water, in case the cladding elements spring a leak, or water penetrates into the cladding elements in any other arbitrary but undesired manner. These lights may alternatively also be arranged directly on seats 25, but as a further alternative reference is made here to a configuration, wherein lights 26 are accommodated in cylindrical, square or otherwise shaped tubes, the ends of which may be sealed closed to shield the lights 26 as an additional protection against salt water or other potentially harmful influences. Such a seal is preferably removable to allow for maintenance and/or LED 26 replacement.

In this or an arbitrary other configuration according to the invention, the compartment layer 22 in assembly with the underlying foundation layer 21 and with the overlying upper layer 24 of the compartment layer 22, the other layers thereon (see below) provide for excellent resistance against for instance impact, pull forces and pressures. For example, PMMA can be used as a material for manufacturing and/or assembling parts and/or components of the cladding elements. If such PMMA parts and/or components are required to be assembled using adhesive or glue, then it should be considered that specially appropriate glue or adhesive may be necessary, and this is naturally also a consideration for other plastics or materials in general.

It is noted that the seats 25 define cross connections between the ribs 23, increasing the strength of the resulting construction. Further, strength of the claddings may be increased by including bulkheads (not shown), which may extend transversely of the trough like light source accommodations, for instance between each pair of neighbouring light sources 26 or with each pair of bulkheads enclosing for instance two, three, five, or any other suitable number of light sources 26. Ribs may additionally or alternatively be arranged to cross each other and be connected at such crossings, to define a strengthening matrix or web, in particular (though not exclusively) with straight ribs.

Preferably, the claddings 20 cover as much area of a surface against which the claddings are to be mounted, such as the hull of a ship. The construction of FIGS. 3, 4 and 5 allows for coverage of huge areas, whilst maintaining strength and integrity.

For fields of application on for instance a yacht or boat, the claddings are preferable further inert to seawater and occasionally relatively extreme temperature fluctuations. To this end suitable material may be chosen, which choice of material is considered to lie within the reach of any person skilled in the relevant art with a regular knowledge level.

In a possible embodiment, the ribs 23 may have reflecting or defusing properties in relation to light emanating from the light sources 26. Likewise, the foundation layer 21 may have reflecting properties and/or even defusing properties. In addition or alternatively, the upper layer 24 of the compartment layer may have diffusing properties. In addition or alternatively, on the upper layer 24, a light diffusing layer 27 can be provided, which in turn can be covered by a top layer 28. A bonding layer 29 may be provided between the diffusing layer 27 and the top layer 28. Likewise, a bonding layer 30 may be provided between the upper layer 24 of the compartment layer 22 and the diffusing layer 27. In alternative embodiments, one or more of the layers 24, 27, 28, 29 and 30 can be integrally formed. Most preferably, diffusing properties will be realised to scatter light from the sourced 25, as it is emitted out of the cladding 20. The top layer 28 can comprise one or more of: a translucent foil, such as 3M IJ3630-20 on for example a 1370 mm wide roll; and a scratch and graffiti resistant protective foil, such as 3M VentureShield on a 1500 mm wide roll. These or other foils may contribute to the desired degree of diffusion of light from the LED light sources 26. A colour could even be realised in or by the foils, such that light from sources 26 can seem to have another colour than white from a distance from the ship or yacht.

Electrical guides 31 can be provided through the compartment layer 22, i.e. between the foundation layer 21 and the upper layer 24 of the compartment layer 22, to enable supply of electrical power to the light sources 26.

Figure 3:
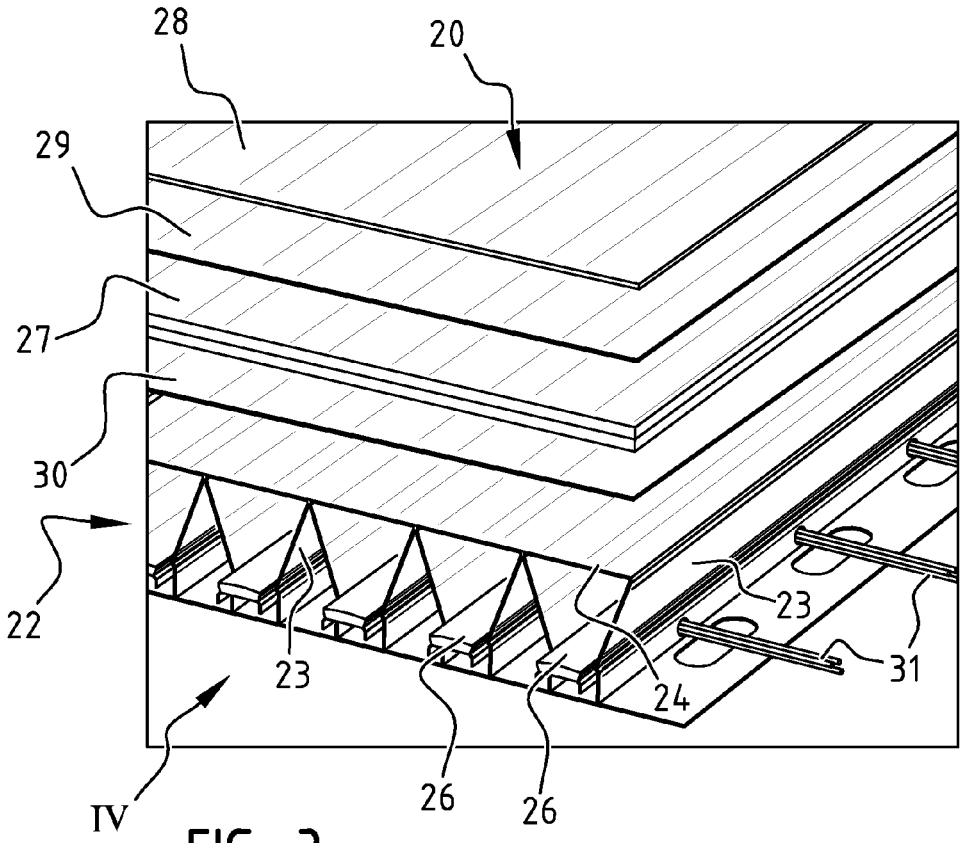
FIG. 3 shows an exploded perspective view of an alternative embodiment of a cladding element in addition to the embodiment of FIG. 2.
Figure 4:
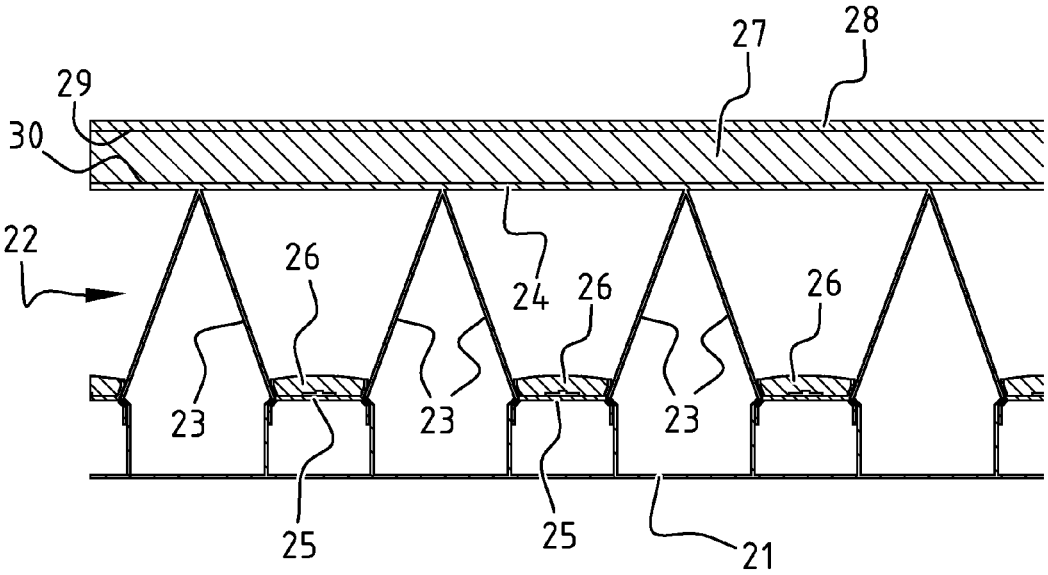
FIG. 4 shows a cross sectional view in the direction of arrow IV in FIG. 3 of the cladding element in assembled state.
Figure 5:
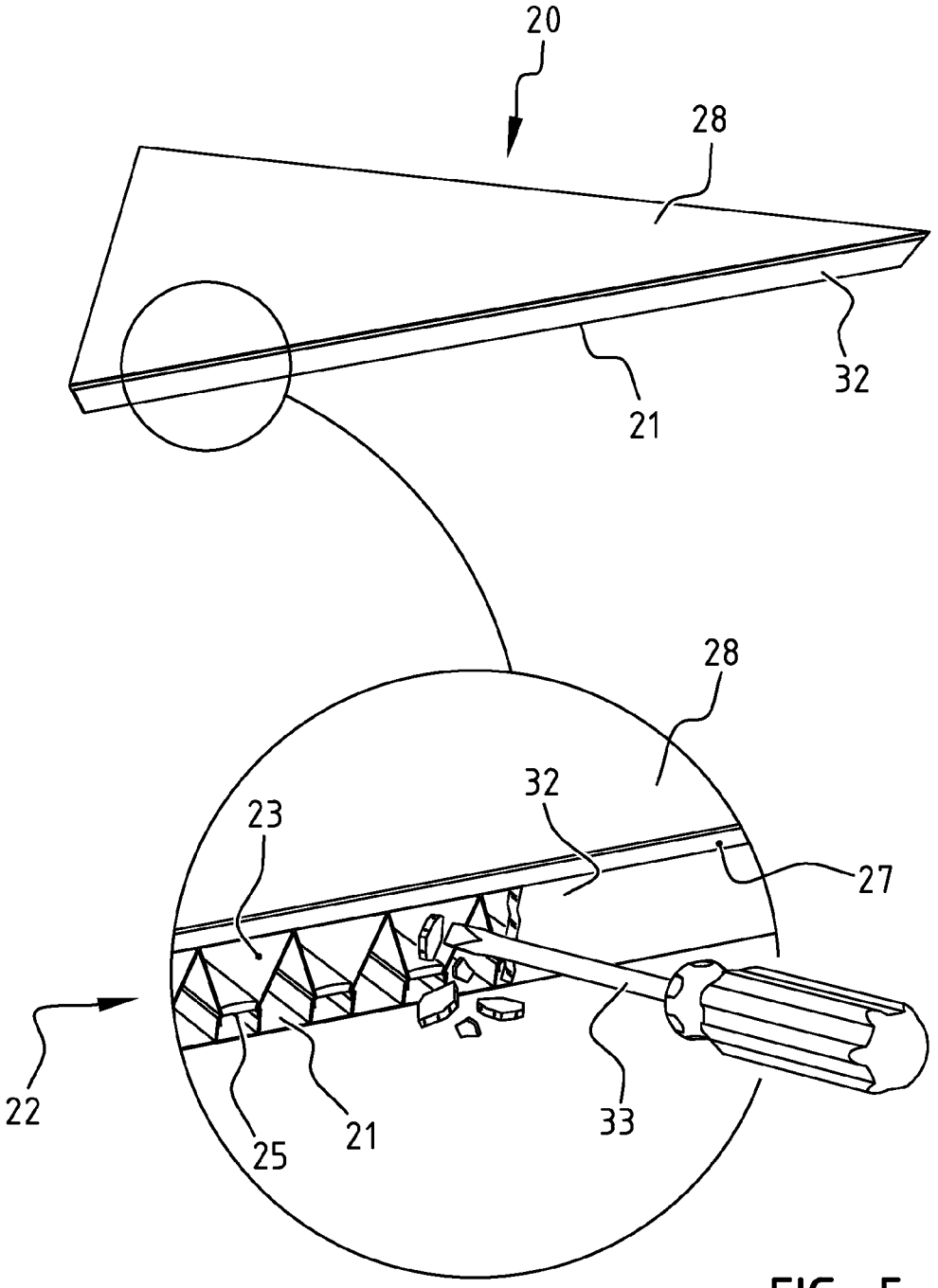
FIG. 5 shows a perspective side view and an enlarged detail of the embodiment of FIGS. 3 and 4.

The top layer 28 is essentially determinative for the exterior appearance of the cladding 20 according to FIGS. 3, 4 and 5. Consequently, measures can be taken as described above to influence this exterior appearance of the cladding 20, such as a coating on the top layer 28 or with the coating as a backing layer of the top layer 28, or a top layer 28 formed by a coating, to simulate or maintain the normal appearance of the object, such as a yacht, to which the cladding is applied, i.e. under daylight or externally illuminated circumstances. However, in the dark, when the light sources 26 are activated, the assembly of layers must be able to pass light outward through the diffusing layer 27 and the top layer 28 in order to provide the sought effect of outward illumination of this object, as indicated also herein above. To achieve this effect, the top layer 28 can be manufactured from a glass or any transparent composite material, especially but not exclusively if a coating is then applied on or behind the top layer 28 to influence the appearance of the cladding in general and of the top layer 28 in particular.

The light diffusing layer 27 diffuses light from the internal light sources 26. Moreover, the transparent or translucent properties of the assembly of the top layer 28, the diffusing layer 27 and the top layer 24 and in particular of the diffusing layer 27 must preferably be such, that the internal configuration of the compartment layer 22 with the ribs 23 and a light sources 26 remains essentially invisible from the outside. Likewise this assembly of layers and in particular the light diffusing layer 27 preferably exhibits a UV filtering capacity to protect underlying composites materials against ageing.

In the embodiment of FIGS. 3, 4 and 5, the compartment layer 22 defines adjoining cavities or accommodations for light sources 26. The light sources 26 are arranged on or in seats 25 and the ribs 23 and the seats 25 of the compartment layer 22 can be or are preferably formed from any one or more than one of: composite material; metal; or other plastics, depending on the field of use. Compartment layer 22 can extend over the entire length or width of a cladding 20, or can be divided into separate components, dividing the length or width of the cladding 20 into a plurality of separate compartments.

As shown in FIG. 5, cladding 20 may be provided with a cast side wall 32. The cast side wall 32 may alternatively or additionally be prepared from thermoplastic material or the like, forming a semi- or fully permanent seal of open sides of the cladding 20, in particular of the compartment layer 22 thereof, to close the cladding against inflow of water, such as sea or rain water. In an embodiment, where the sealing side wall 32 is semi- or fully permanent, access may at times be desired for maintenance of the light bulbs 26 or the seats 25 or the ribs 23, et cetera. In this case, the sealed sides may need to be forcefully opened, possibly inflicting damage thereto, for instance using a tool, such as the schematically represented screw driver 33. However, the sides of portions thereof, that are broken open for maintenance or replacement of light sources 26 can be closed or sealed again in much the same manner as during original manufacture of the cladding 20, for instance by casting a setting material on said sides, or by applying molten thermoplastic material thereon. Even dipping sides of the cladding 20 in a bath of resin or thermoplastic material is optionally possible.

Even though the cladding of FIGS. 3, 4 and 5 has been described in conjunction with the field of application of yachts, where the claddings are mounted to the hull of a boat, ship or yacht, it should be noted here that the cladding may very well also be usefully employed in the fields of:

swimming pools and in particular side walls and/or bottoms thereof, as well as on surrounding structures, like a pool house or paths or pavements there around;

bridges, for example on bridge decks and/or against uprights and/or stairs and/or walls;

ornamentation of public spaces and public structures, like street furniture, roads, pavements, stairs, 3-D structures like art, separation structures, walls;

building facades; and the like. The cladding elements could even be employed as floor elements, for example to define a dance floor, for which the foundation layer would preferably be flat.

Further, the claddings may be produced in any appropriate shape or form, such as rectangular, triangular, honeycomb shaped, square, circular, elliptical, star shaped, amoebae shaped, banner shaped, et cetera. The claddings 20 may even be formed during production to exhibit a curvature in correspondence with a base surface, such as a hull of a ship, against, on or to which the claddings are intended to be mounted. In addition it is noted that claddings according to the invention are preferably such that ingress of dust, moisture and liquid is restricted. For such properties Ingress Protection (IP) codes or ratings have been developed in the art. An overview can be found at for example: http://en.wikiedia.org/wiki/IP_Code. For the present exemplary field of use of a cladding on a hull of a yacht, an IP rating may suffice of IP68 (dust tight and able to withstand ingress of harmful quantities of water when immersed beyond 1 meter) or the even lower rating IP67 (same criteria for product immersed up to 1 meter). For other fields of use; suitable rating can be determined, based on the specific circumstances and potentially harmful influences in such another field of use.

From the foregoing description of a possible embodiment of a yacht according to the present invention it will be abundantly clear that the invention is by no way to be interpreted in a limited sense as restricted to any of the particular features of any embodiment as described above. Instead, limitations on the present invention only result from the definitions of the invention in the appended claims, in particular the appended independent claims.

The invention claimed is:

1. A vessel, comprising: a hull and a superstructure, wherein at least one surface of the hull and/or of the superstructure comprises cladding elements thereon or therein, wherein at least a selection of the cladding elements comprise an at least partially transparent cover and at least one light source, wherein the light source is shielded by the cover, wherein the cladding elements are cassette-like and are configured to cover the at least one surface of the hull and/or of the superstructure in a mutually closely fitting adjoining configuration of sets of the plurality of cassette-like cladding elements, and wherein the cassette-like cladding elements are arranged on the at least one surface facing outward, to cover the at least one surface for essentially the most part in the closely fitting adjoining configuration to emit light from the at least one surface over which the cassette-like cladding elements are arranged in the closely fitting adjoining configuration generating the appearance of light emitted from essentially the entire surface of the hull and/or of the superstructure.

2. The vessel as claimed in claim 1, wherein transitions between cladding elements are closed with an essentially watertight seal.

3. The vessel as claimed in claim 1, wherein the at least one light source comprises light elements of different colours, and wherein a control is connected to the light elements and the control comprises input means to adapt a cladding element appearance.

4. The vessel as claimed in claim 1, further comprising either one of: brackets secured to the hull and arranged to engage one or more than one of the cladding elements; and wherein the cladding elements are connected to the hull by adhesive or glue.

5. The vessel as claimed in claim 1, wherein the hull is formed with an indentation to accommodate the cladding elements.

6. The vessel as claimed in claim 1, wherein cladding elements are arranged on the hull above a waterline of the vessel.

7. The vessel as claimed in claim 1, wherein the at least one light source is arranged between ribs extending at least from the light source to the cover.

8. The vessel as claimed in claim 1, wherein at least one of the cladding elements comprises a backing with the light source thereon, wherein the transparent cover is arranged opposite the backing encapsulating the light source there between.

9. The vessel as claimed in claim 8, wherein the backing is curved in correspondence with a portion of the hull to which the cladding element is arranged.

10. The vessel as claimed in claim 8, wherein on or in the transparent cover, opposite the backing, a light diffusing layer is arranged or a circumferential side of the transparent cover comprises a light reflecting layer.

11. The vessel as claimed in claim 1, wherein at least a selection of cladding elements forms a cassette designed to be individually mountable to or dismountable from the hull and connectable to and disconnectable from a light source control for separate mounting and light controlling of the cladding elements.

12. The vessel as claimed in claim 1, wherein sides of the cladding are sealed using at least one material from a group at least comprising: a setting material, a thermoplastic material.

13. The vessel as claimed in claim 1, wherein the at least one of the surfaces of the cladding from the group of: a backing; a compartments layer; a top; and a side surface is designed to be at least water resistant or water proof to a desired extent, while additionally being adapted to be removed from the cladding to allow for maintenance to the interior of the cladding and/or replacement of light sources in the interior thereof.

14. The vessel as claimed in claim 1, wherein a top coat paint is arranged on or over the at least partially transparent cover, which top coat is designed to give the impression of a normally coloured hull, when the lights sources are switched off, for example in the day time, and to be light transmitting to illuminate outward of the hull, when the light sources are lit.

15. A cladding element containing a plurality of light sources arranged on the at least one surface of the hull or the superstructure of the vessel as claimed in claim 1.

16. The vessel of claim 1, wherein the claddings have a shape appropriate for the closely fitting adjoining configuration.

17. The vessel of claim 16, wherein the shape of the claddings is rectangular, triangular, honeycomb shaped, square, circular, elliptical, star shaped, amoebae shaped, or banner shaped.

18. The vessel of claim 1, wherein the vessel is a ship or a yacht.

19. The vessel of claim 3, wherein the light elements are LED lights.

* * * * *